United States Patent [19]

Niehaus et al.

[11] 4,021,949

[45] May 10, 1977

[54] ILLUMINATED SIGN SYSTEM

[75] Inventors: Donald H. Niehaus, Crestview Hills, Ky.; Nick J. Schwab, Cincinnati, Ohio; Patrick J. Seggerson, Fort Mitchell, Ky.

[73] Assignee: American Sign and Advertising Services, Inc., Florence, Ky.

[22] Filed: Apr. 7, 1976

[21] Appl. No.: 674,611

[52] U.S. Cl. ..... 40/132 R; 40/63 R; 40/125 R; 40/142 R

[51] Int. Cl.[2] ..... G09F 13/04

[58] Field of Search ..... 40/132 R, 132 D, 130 R, 40/152.2, 135, 63 R, 133 B, 140, 142 R, 125 H, 125 R, 128, 143

[56] References Cited

UNITED STATES PATENTS

| | | | |
|---|---|---|---|
| 2,966,754 | 1/1961 | Orkin | 40/132 R X |
| 3,079,714 | 3/1963 | Zeigler et al. | 40/140 X |
| 3,339,301 | 9/1967 | Doris et al. | 40/63 R X |
| 3,500,569 | 3/1970 | Simmons | 40/132 R |
| 3,605,303 | 9/1971 | Reichow | 40/63 R |
| 3,771,245 | 11/1973 | Mabrey et al. | 40/132 R X |
| 3,780,284 | 12/1973 | Dewhirst | 40/132 R X |
| 3,992,872 | 11/1976 | Stanish | 40/130 R X |

*Primary Examiner*—John F. Pitrelli

*Attorney, Agent, or Firm*—Cushman, Darby & Cushman

[57] ABSTRACT

The sign includes a generally rectangular, pan-shaped opaque back, with its concavity presented forwards a generally rectangular, pan-shaped translucent front, frame or shell with its concavity presented rearwards, and means for fastening the back to the shell. The forward part of the shell is provided with at least one generally rectangular port bordered on at least two opposing sides with a ledge. Preferably lighting means is mounted on the back and any of several translucent sign faces are mounted across the ledges to span the port. Typical sign faces are: a translucent clock face with a clock mechanism behind and hands in front and a covering crystal that is transparent; a sandwiching of a translucent light diffuser, a color transparency and a clear cover; a translucent panel with rows of parallel grooves for removably mounting the characters for changeable messages; and translucent panels with messages or other advertising applied directly thereto. A variation is disclosed wherein the sign includes a stored supply of products which are both advertised thereby and dispensed therefrom. In some embodiments, the shell includes two such ports, with sign faces of either like type or two different types. The principal sign port is preferably tilted from parallelism with the rear of the back.

18 Claims, 9 Drawing Figures

ILLUMINATED SIGN SYSTEM

BACKGROUND OF THE INVENTION

The appearance and construction of illuminated point of purchase signs are many and varied. For a sign manufacturer and supplier, that has called for a need to tool for, manufacture, stock and supply a large number of different parts for meeting varied requirements and that leads to substantial expenses.

Often, illuminated signs are meant to be hung against a store wall or the like. When something goes wrong, for instance when a lamp or starter burns out, or when the sign servicer or proprietor wishes to change the sign face or change the message conveyed thereby, it is often necessary to demount the sign from the wall and to substantially disassemble it. This is cumbersome and raises the risk that the sign will be broken or suffer from all this handling. Too, the difficulty of changing or fixing such signs tends to cause their servicers or proprietors to let them hang in a broken or obsolete condition for long times after the need to do something about their condition has first been noticed.

SUMMARY OF THE INVENTION

The present invention provides a family of attractive, versatile signs, and the individual members thereof, which can be assembled from a source of a lesser number of different parts than is required for such a number of different signs in the prior art. The invention also provides such signs with means for servicing their interior and altering their sign faces from the front, so that, for most instances, the sign may remain mounted while it is being serviced and changed.

The sign includes a generally rectangular, pan-shaped opaque back, with its concavity presented forwards a generally rectangular, pan-shaped translucent front, frame or shell with its concavity presented rearwards, and means for fastening the back to the shell. The forward part of the shell is provided with a least one generally rectangular port bordered on at least two opposing sides with a ledge. Preferably lighting means is mounted on the back and any of several translucent sign faces are mounted across the ledges to span the port. Typical sign faces are: a translucent clock face with a clock mechanism behind and hands in front and a covering crystal that is transparent; a sandwiching of a translucent light diffuser, a color photographic transparency and a clear cover; a translucent panel with rows of parallel grooves for removably mounting the characters for changeable messages; and translucent panels with messages or other advertising applied directly thereto. A variation is disclosed wherein the sign includes a stored supply of products which are both advertised thereby and dispensed therefrom. In some embodiments, the shell includes two such ports, with sign faces of either like type or two different types. The principal sign port is preferably tilted from parallelism with the rear of the back.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION OF PRESENTLY PREFERRED EMBODIMENTS

Figure 1:
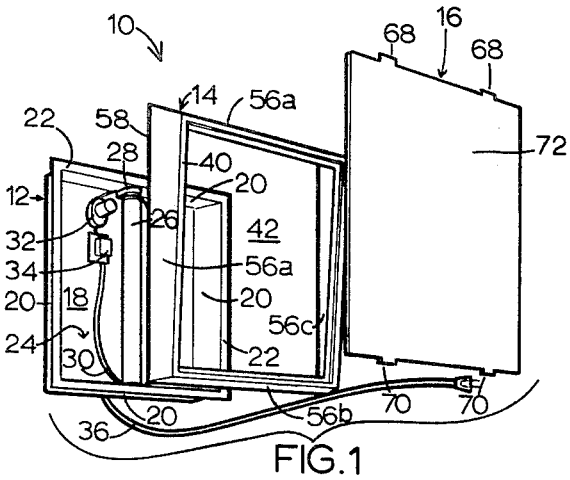
FIG. 1 is an exploded perspective view of a one panel illuminated sign in a variation wherein advertising copy or the like is applied directly to the panel.

Referring to FIG. 1, there is shown a sign 10 which comprises a back 12, a shell 14 and a sign face panel 16.

The back 12 is rectangular, generally pan-shaped with a generally vertical, generally flat rear wall 18 peripherally surrounded by two pairs of mostly forwardly, slightly outwardly projecting sidewalls 20 which end in a perimetrically continuous, outwardly projecting rim or flange 22. Accordingly, the back 12 includes a forwardly opening concavity or recess 24. Within this concavity, a lamp tube 26 is shown mounted in a fixture 28, electrically connected via wiring 30, through a starter 32 and ballast 34 to an electric power cord 36, e.g., provided with a standard, pronged plug.

In the model depicted, a single, fluorescent lamp tube 26 is provided. In practice, the electrical lighting gear can be provided as shown, or eliminated, or multiplied to provide two or more lamp tubes, or replaced with any other conventional lighting means. The wiring shown is so-called "non-U.L." because it lacks raceways for the wiring 30. However, it may just as readily be made to have raceways and otherwise to conform to U.L. requirements. ("U.L." stands for Underwriters Laboratories, Inc.).

By preference, the back 12 is injection molded in one piece, of opaque plastic material such as high impact, heat and light stabilized polystyrene, although it could be made of other materials by other methods.

Figure 5:
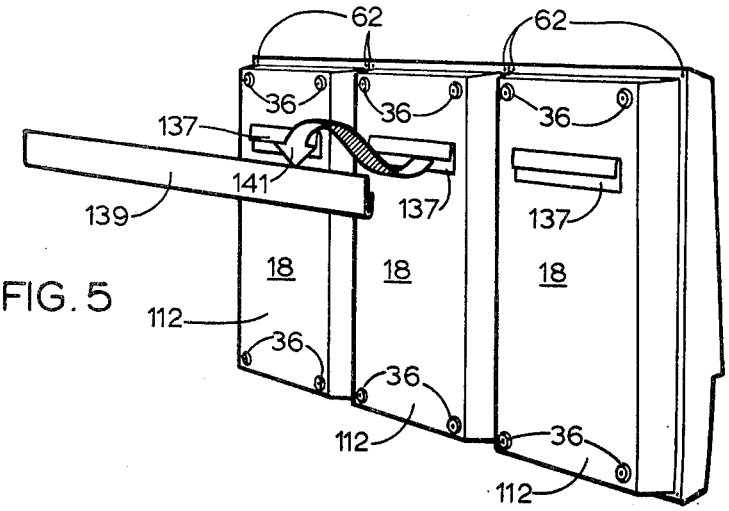
FIG. 5 is a rear perspective view showing three of the two panel illuminated signs with back bracket and wall bracket means for mounting them side by side on a wall.

As is true of the FIG. 1 embodiment, but shown best in FIG. 5, four feet 36 are preferably molded on the rear of the rear wall 18, one near each corner, so that when the sign is mounted against a wall, the feet 36 engage the wall and cause the rear of the rear wall 18 itself to stand slightly away from the wall against which the sign is mounted.

The front, shell or frame 14 is also generally rectangular and generally pan-shaped, but in this instance the forwardly presented portion is constituted by a narrow band 40 bordering the four sides of a generally rectangular part or aperture 42. As is true of the FIG. 1 embodiment, but shown best in FIG. 8, the band 40 includes an outer, generally flat portion 44 having a shallow rearwardly projecting portion 46 at its inner edge. In turn, the portion 46 has a narrow, inwardly projecting portion 48 at its rear edge (so that the portion 48 is generally parallel to, but stepped back from, the portion 44). The inner edge 50 of the portion 48 defines the border of the aperture 42. Thus, the structure 42 – 50 provides an open-backed recess 52.

Figure 8:
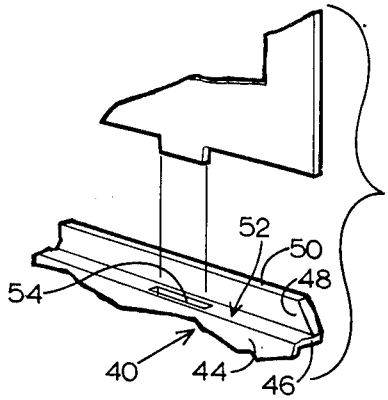
FIG. 8 is a larger scale fragmentary exploded perspective view of the basic preferred embodiment, showing a way of mounting the sign face in the shell aperture.

At e.g. two transversally spaced sites along at least two opposite ones of the band 40 sides, (corresponding to the side walls 56*a*, 56*b*) the rearwardly projecting portions 46 are provided with narrow, elongated slots 54, one of which shows best in FIG. 8. (The slots 54 and recess 52 help removably mount the sign face as will be explained in more detail hereafter.)

The frame 14 also includes four sidewalls 56 projecting generally rearwardly and somwhat outwardly from the outer periphery of the aperture-bordering band 40. By preference, one of these walls, 56*a*, is deeper (front to rear) than its opposite number, 56*b*, and the other pair, 56*c* have one correspondingly deeper edge, next to the wall 56*a*. The rear edge 58 of the walls 56 forms a rectangle that is substantially the same size and shape as the outer edge of the back flange 22.

Figure 7:
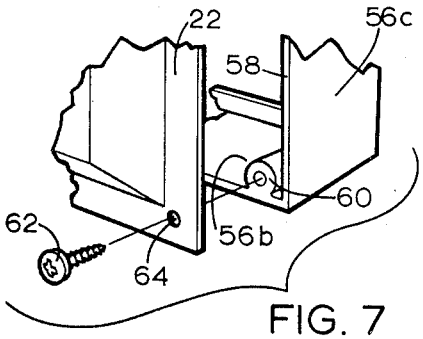
FIG. 7 is a larger scale fragmentary exploded perspective of the basic preferred embodiment, showing a way of securing the shell to the back.

As is true of the FIG. 1 embodiment, but best shown in FIG. 7, nubs of material 60 are strategically provided on the inner surface of the sidewalls 56 adjoining the rear edge 58, to permit screws 62 to be screwed through the back flange 22 at 64 into the respective nubs 60 to hold the frame 14 assembled to the back with the back flange 22 in abutting registry with the rear edge 58.

Accordingly, due to the difference in the depth of the walls 56*a*, 56*b*, when the frame and back are secured together at 62, the plane of the ledge 48 is out of parallel with the plane of the rear wall 18 of the back 12 by, e.g. roughly 5°. The frame 14 is preferably injection molded in one piece, of translucent plastic material such as medium impact, light stabilized polystyrene, although it could be made of other materials by other methods.

In the embodiment shown in Fig. 1, the sign face panel 16 is constituted by a flat, generally rectangular plate 66, e.g. of translucent plastic material such as translucent white polystyrene. The plate 66 is shown provided at two transversally spaced sites along two opposite edges with outwardly projecting tabs 68, 70. When the sign face panel 16 is to be installed in the open-backed recess 52 to bridge the aperture 42, the tabs 68 are slid all the way into one set of slots 54, the panel 16 is pushed in flatwise against the ledge 48, and the panel 16 is slid laterally in its plane slightly away from the slots 54 in which the tabs 68 are received until the tabs 70 also enter the corresponding slots 54 on the opposite side of the border.

Thus the receipt of the tabs 68, 70 in the slots 54 removably holds the panel 16 in place across the aperture 42. Because the panel 16 is of translucent material it acts as a light diffuser when the power cord 36 is plugged in and the lamp tube 26 is lit.

There are many ways an advertising or instructional message can be applied to the outer surface 72 of the diffuser panel 16. For instance, indicia, pictorial material or the like, may be silk-screened or otherwise stenciled thereon; a changeable message may be applied thereon with a crayon or grease pencil; opaque or translucent cut-out letters or other characters may be applied thereto e.g. by solvent welding or with pressure sensitive adhesive. The foregoing are non-exclusive examples, since advertising or instructional material may be removably or permanently applied to the panel 16 in any conventional manner. One can easily see how the panel 16 will stay in place, but be removable for access to the interior of the sign (for instance for cleaning or changing the lamp tube 26) or for changing the indicia on the panel 16 (if it is removably applied thereto) or for exchanging that panel 16 for another one with new or different indicia applied thereon. All this can be done without taking the sign apart at 62 and without demounting the sign from where it may hang.

It should be apparent, and will be from the whole of this specification, that the panel 16 may be supplemented or replaced with any other one of the sign faces disclosed herein (for instance a clock, transparency, clear cover, changeable copy menu panel or the like).

As a visually, striking feature, when the back 12 is opaque and the frame 14 and panel 16 are translucent, the panel 16 and the sides 56 also are lit brightly when the lamp 26 is turned on.

Figure 2:
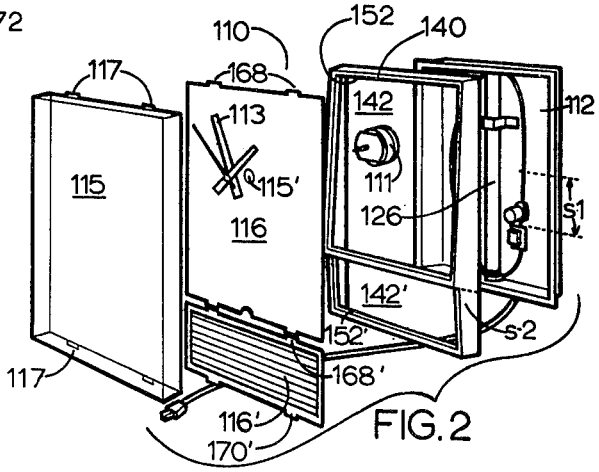
FIG. 2 is an exploded perspective view of a two panel illuminated sign in a variation wherein one panel provides a clock face, having a removable transparent cover and a second panel constitutes a translucent mounting board for changeable characters.

Turning now to FIG. 2, a variation is shown at 110, wherein the shell 114 has, beside the generally rectangular aperture 142, a second, smaller generally rectangular aperture 142′. The apertures 142, 142′ are defined by corresponding open-back recesses 152,152′ which are substantially like the recess 52 of the FIG. 1 embodiment.

In practice, it is preferred to make the sign embodiment 110 from the same molds as the embodiment 10, by adding extra sections to the molds for molding a center "stretched" section S1 for the back 112 and the portion S2 of the frame which are set off by imaginary dashed lines in FIG. 2.

Note that the smaller open-back recess 152′ is tipped in an opposite direction from the open-back recess 152. For instance, in the FIG. 2 orientation, the aperture 142 is tipped upwards slightly and the aperture 142′ is tipped downwards slightly.

Properly sized sign front panels of any of the types shown or otherwise disclosed herein may be used in the open-back recesses 152, 152′.

As an example, the recess 152 receives a translucent clock face panel 116 (which may bear a circular track of clock numerals and/or tick-marks, not shown). In such case the clock mechanism 111 is mounted back of the panel 116, either on the panel 116 or on the back 112 and a set of clock hands 133 is mounted on the shaft means of the mechanism 111 which protrudes forwardly through an opening 115′ formed through the panel 116. The mechanism 111 may be wired into the same circuit as the lamp tube 126, or be battery operated or the like. A crystal 115 of clear, transparent polystyrene may also be provided for removably covering the clock face. The crystal 115 is generally rectangular and generally pan-shaped. Two of its opposed corresponding rear edges are provided with tabs 117 which fit in the same slots as do the tabs 168, 170 on the clock face 116.

Figure 9:
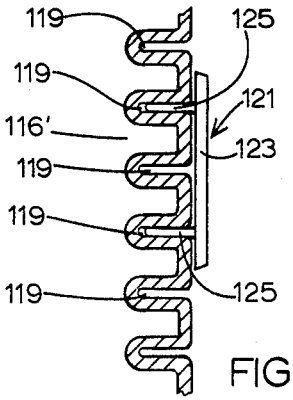
FIG. 9 is a larger scale fragmentary exploded perspective view of an indicia character being removably mounted on a changeable copy / menu board of FIG. 2 or 4.

As a further example, the recess 152' receives a changeable copy / menu panel 116' a portion of which is shown in detail in FIG. 9. Referring to the latter Figure, the panel 116' is preferably made of translucent plastic material such as polystyrene, and has a plurality of generally parallel, vertically spaced, horizontal rows of forwardly opening grooves 119. A font of sign characters exemplified by the character depicted at 121 are provided. These may comprise letters, numbers, punctuation marks and the like, each of which has a plate portion 123 and one or more rearwardly projecting tabs 125. The characters 121 are removably mounted on the panel 116' by pushing the tabs 125 into the grooves 119 to be frictionally gripped therein.

Note with respect to the embodiment of FIG. 2, that the sign interior is accessible from the front by removing either the crystal 115 and panel 116 or removing the panel 116', or all of them. Note also that the menu or other information or advertising characters 121 placed on the panel 116' can be changed without disturbing the clock or its crystal, and with or without removing the panel ll6' from its mount.

(Although the smaller panel 116' is shown mounted with tabs 168', 170' the same way the panel 116 is mounted, it may, instead be permanently adhered or solvent welded to the border of the aperture 142', in which case access to the interior of the sign 110 will be via removal of the clock panel 116.)

Figure 3:
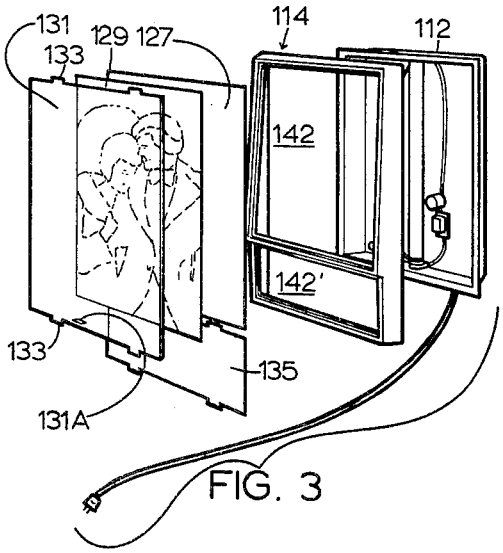
FIG. 3 is an exploded perspective view of the two panel illuminatd sign in a variation wherein advertising copy or the like is sandwiched on a transparency between a transparent cover and a translucent diffuser and the other panel is adapted for direct application of advertising copy.

The embodiment shown in FIG. 3 uses the same frame 114 and back 112 as are shown in FIG. 2, but substitutes sign panels of different types.

The larger recess 142 is shown receiving a three layer sandwich of the following components: a translucent diffuser plate 127 like the panel 16 of FIG. 1, but without mounting tabs, a transparency 129 and a clear crystal 131 with lifting tab 131A which is like the clock crystal 115 of FIG. 2, except that it is flat. Its tabs 133 fit in the same slots as do the tabs 117, 168, 170 of FIG. 2, to hold the sandwiched sign face panel 127, 129, 131 in place in the recess 142.

The smaller recess 142' in FIG. 3 is shown receiving a translucent plate 135 that is a correspondingly smaller version of the panel 16 of the FIG. 1 embodiment.

Figure 4:
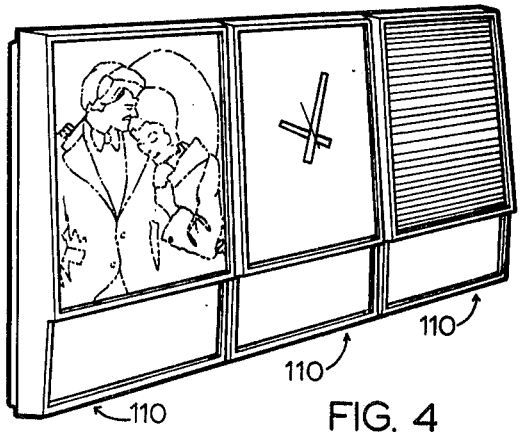
FIG. 4 is a perspective view showing three of the two panel illuminated signs mounted side by side in a row.

FIG. 4 shows how several (e.g., three) signs 110 with the same, similar or different sign face panels may be ranked side-by-side to provide a sign system. Such a system has utility, for instance for use above and back of the counter at a fast food restaurant, refreshment stand, passenger waiting terminal or the like. Note that, without respect to the difference in sign face panels, the system appears harmonious in its parts, and that portions of the lit, translucent fronts are visible as framing around all of the sign face panels even when the widest parts of the signs are abutted side-to-side, as shown.

FIG. 5 illustrates one way the signs of FIG. 4 may be mounted to provide such an integrated system. That is, back brackets 137 may be secured at corresponding locations on the rear of the backs 112 and a single wall bracket 139 may be secured on the wall (not shown) where the sign system is to be located.

The arrow 141 shows the direction the three signs 110 are moved to hook their brackets 137 on the wall bracket 139. By preference, marks or holes (not shown) are molded into the backs 112 when the backs 112 are made, so that the brackets 137 can be easily precisely correspondingly spatially oriented on the several signs 110. Thus, when the signs 110 are hung side by side on a single bracket 139, they will be in a uniform horizontal row.

The signs 110 are not restricted to having the particular faces shown, but can have any similar face panels, all alike, all different or several alike and others different. Note too, that a row of several signs 10 may be mounted just like a row of several of the signs 110. Note also, that a row of signs can be provided in which includes some one-panel signs 10 and some two-panel signs 110. Signs each with three or more panels could also be provided without departing from the principles of the invention. Any of the sign faces shown without crystal covers may have the same provided where keeping dust out and permitting cleaning without disturbing the advertising copy are important objects. Likewise, where dust and cleaning are not a problem, the crystals shown may be omitted.

Consider also the following elaborations upon the basics which are described and shown: motor-rotated diffraction grating or light polarizing disks may be provided behind transparency-type sign face panels to provide illusion of motion, or kaleidoscopic effects or the like. Pockets with or without hinged or slidable covers may be provided as or in the sign face panels to permit the display or dispensing, directly from the sign, of the products advertising by the sign, (see FIG. 6 for an example). The border 40 or 140 or any narrower band thereof may be hot stamped with gold, silver or the like for added attractiveness. The preferably translucent or opaque white portions of the signs may, instead be molded in colors. The signs may be suspended back to back, or with an (unshown) common back for opposed frames to permit confronting observers approaching from two opposite directions. The signs are useful even when the electric lighting shown therein is turned off or omitted. The signs 10, 110 are not restricted to being hung in the orientations shown. For instance, the signs may be turned 90° , 180° or 270° (e.g. about the clock mechanism shaft) and still be attractive and useful (provided, of course, that the indicia is applied right-side-up, whatever the sign orientation).

Solely for the purpose of illustration, the signs 10 may have an overall size of 16 inches × 19¾ inches × 6 inches and the signs 110 may have an overall size of 16 inches × 25½ inches × 6 inches or 12 inches × 17 inches × 5½ inches (in a scaled-down version).

When several signs 10 and/or 110 displayed together for a unitary effect, they need not be connected or abutting; instead, they may be individually hung in a row with some spacing between adjacent signs. Any array of a plurality of the signs need not include exactly three of them. Any number from one to many of the signs may be arrayed at one location for a common purpose. In an array of the signs 110, it is likely that often, the smaller panel 116' will be constituted by a trademark or other logo, for instance, for a widely known soft drink or other beverage. The signs are, of course, not limited to use in connection with restaurants, since many other products, such a lawn mowers and photographic film can be similarly advertised. Nor are the signs limited to use for stimulating the sale of products or services, for they may be used just as well to provide public information, such as the time a boss may be expected, the direction to rest rooms or the appearance of a beautiful outdoor scene for a location which has none or for a place which has no windows.

Figure 6:
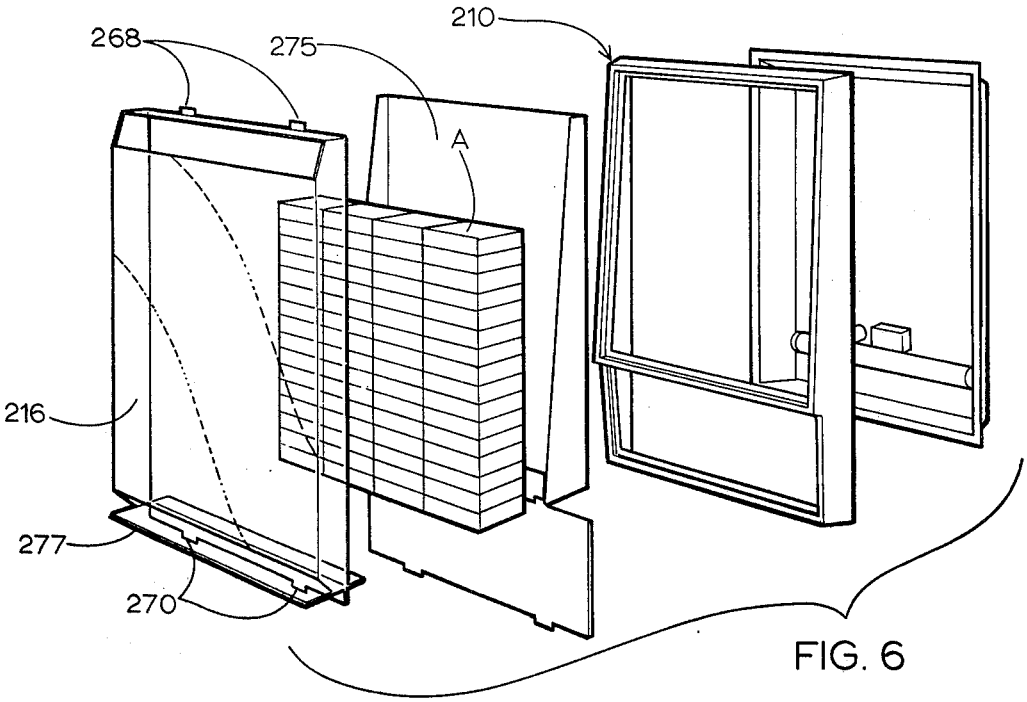
FIG. 6 is an exploded perspective view of a dispensing version of the sign.

In the variation shown in FIG. 6, corresponding parts to those of FIG. 1 are similarly numbered but raised by 200, and by 100 with respect to FIGS. 2 and 3. In general, a receptacle 275 is mounted in the sign 210, within larger aperture, and covered with a sign face panel/crystal 216, whose tabs 268 function as hinges for tilting the sign face panel/crystal 216 upwards to render the individual articles A accessable. (The articles A are, for instance, rolls of film, magnetic tape cassettes, bars of soap or the like.) The tabs 270 function as keepers when the member 216 is closed. A prominent forwardly - projecting tab is provided on the member 216 at 277 as a handle to permit the member 216 to be easily lifted and tilted out about the tabs 268 for access to the articles A. Of course, where necessary, a lock could be provided for the member 216.

It should now be apparent that the Illuminated Sign System as described hereinabove, possesses each of the attributes set forth in the specification under the heading "Summary of the Invention" hereinbefore. Because the illuminated sign system can be modified to some extent without departing from the principles of the invention as they have been outlined and explained in this specification, the present invention should be understood as encompassing all such modification as are within the spirit and scope of the following claims.

What is claimed is:

1. A sign, comprising:

a. a pan-shaped back, having a rear wall and sidewall means peripherally joined to the rear wall, the sidewall means extending generally forwardly, thereby providing the back with a concavity which opens forwardly;

b. a pan-shaped front, having a front wall and sidewall means peripherally joined to the front wall, the sidewall means extending generally rearwardly, thereby providing the front with a concavity which opens rearwardly;

c. the sidewall means of the back terminating distally of the back wall in a perimetrical rim;

d. the sidewall means of the front terminating distally of the front wall in perimetrical edge means;

e. said back and front being disposed in adjacency with the perimetrical rim of the back being adjacent and in registry with the perimetrical edge means of the front;

f. securement means on the back and front maintaining said adjacency and registry;

g. means defining a relatively large aperture through said front wall of said front, said aperture being spaced from said sidewall means of said front, perimetrically of said aperture by said front wall, so that said front wall and the sidewall means of said front do border and frame said aperture;

h. said front wall, immediately adjacent where said front wall borders said aperture, including generally L-shaped ledge means including a first portion which extends rearwardly, and a second portion which extends inwardly, so that the L-shaped ledge means provides a recess, through which said aperture opens;

i. a sign face panel having an outer peripheral edge portion, said sign face panel being received in said recess, spanning said aperture and having said outer peripheral edge portion supported upon said L-shaped ledge means;

the pan-shaped back, the pan-shaped front, the aperture and the sign face panel all being generally rectangular, so that said aperture has two sets of opposed sides;

said L-shaped ledge means being provided on both of the opposed sides of at least one of said two sets of opposed sides of said aperture;

j. a plurality of outwardly projecting tabs on said sign face panel extending from spaced sites along the peripheral edge portion thereof;

k. means defining correspondingly spaced slots in the rearwardly extending first portion of the L-shaped ledge means;

said tabs being removably received in the slots to removably secure the sign face panel across the aperature;

l. an electric lamp;

m. means mounting the electric lamp on the pan-shaped back in said concavity thereof; and said sign face panel including at least a portion capable of transmitting light, whereby said electric lamp, when lit, back-lights the sign face panel, and whereby said lamp may be serviced through said aperture upon removal of said sign face panel.

2. The sign of claim 1, wherein:

said sign face panel is constituted by a clock face or translucent material; and said sign further includes:

means defining a small opening through the clock face;

a clock mechanism mounted behind the clock face and having a shaft means projecting forwardly through said small opening in the clock face; and a set of clock hands mounted on said shaft means in front of the clock face.

3. The sign of claim 1, wherein:

the sign face panel includes:

means defining a plurality of vertically spaced, forwardly opening, horizontally extending grooves therein; and said sign further includes;

a plurality of character elements, each including:

a character plate in the shape of a character of indicia, and at least one tab projecting rearwardly from each character plate, these tabs being removably inserted in respective of said grooves to provide changeable lines of indicia on the sign face panel.

4. The sign of claim 1, wherein:

the sign face panel includes:

a diffuser plate of translucent material and, superimposed thereupon, an indicia-bearing sheet of film transparency, whereby said film transparency is illuminated from behind via said diffuser plate.

5. The sign of claim 1, wherein:

the pan-shaped front is made of translucent material so that when said lamp is lit, said pan-shaped front is illuminated from behind.

6. The sign of claim 5, wherein:

said sidewall means of said pan-shaped front, besides extending generally rearwardly also diverges slightly so that said sidewall means, when illuminated from behind, is largely visible over its full depth from directly in front of said sign.

7. The sign of claim 6, further including:

hanger means secured on the rear side of said rear wall of said pan-shaped back, a wall hanger for securement on a wall, said wall hanger extending horizontally a greater extent than said sign;

said hanger means on said pan-shaped back being hooked upon said wall hanger, and whereby additional signs like said sign may be supported from said wall hanger beside said sign, yet have the illuminated sidewall means of each remain largely visible over the full depth thereof from directly in front thereof.

8. The sign of claim 1 wherein:

said securement means removably securing the sign face panel to the pan-shaped front is constituted by hinging means; and said sign further includes:

receptacle means between said pan-shaped front and said pan-shaped back, accessible from outside said sign by:

pivoting the sign face panel about said hinging means;

said receptacle means being configured to accept and support a supply of articles, whereby articles may be stored within and dispersed from said sign.

9. The sign of claim 1, wherein:

said securement means comprise screws passing through said rim of said back and into said front.

10. The sign of claim 9, wherein:

the pan-shaped back is an injection molded integral member;

the pan-shaped front is an injection molded integral member, having means defining protuberant nubs at spaced locations on the inner side of said sidewall means of said pan-shaped front; and said screws which pass into said front pass into said nubs.

11. The sign of claim 1, wherein:

said ledge means, and thus said aperture, is slightly tipped with respect to the imaginary plane of said rear wall of said pan-shaped back, so that said sign face panel is presented towards a viewer directly in front of the sign at an angle slightly different from normality.

12. The sign of claim 1, further including:

means defining a second, smaller aperture through said front wall of said front, this second aperture being laterally spaced fron the first-described aperture on said front wall of said front, so that some of said front is visible between the first-described aperture and said second aperture, said second aperture being spaced from said sidewall means of said front, perimetrically of said second aperture by said front wall, so that said front wall and the sidewall means of said front do border and frame said second aperture; and a second sign face panel having an outer peripheral edge portion, said second sign face panel spanning said second aperture and having said outer peripheral edge portion thereof being secured to said front wall.

13. The sign of claim 12, wherein:

said front wall, immediately adjacent where said front wall borders said second aperture, including second generally L-shaped ledge means including a first portion which extends rearwardly, and a second portion which extends inwardly, so that the second L-shaped ledge means provides a second recess, through which said second aperture opens;

said second sign face panel being received in said recess and having said outer peripheral edge portion supported upon said second L-shaped ledge means.

14. The sign of claim 13, wherein:

the second sign face panel includes:

means defining a plurality of vertically spaced, forwardly opening, horizontally extending grooves therein; and said sign further includes:

a plurality of character elements, each including: a character plate in the shape of a character of indicia, and at least one tab projecting rearwardly from each character plate, these tabs being removably inserted in respective of said grooves to provide changeable lines of indicia on the second sign face panel.

15. The sign of claim 13, wherein:

the second sign face panel includes:

a diffuser plate of translucent material and, superimposed thereupon, an indicia-bearing sheet of film transparency, whereby said film transparency is illuminated from behind via said diffuser plate.

16. The sign of claim 13, wherein:

the pan-shaped front is made of translucent material so that when said lamp is lit, said pan-shaped front is illuminated from behind.

17. The sign of claim 16, wherein:

said sidewall means of said pan-shaped front, besides extending generally rearwardly also diverges slightly so that said sidewall means, when illuminated from behind, is largely visible over its full depth from directly in front of said sign.

18. The sign of claim 17, wherein:

hanger means secured on the rear side of said rear wall of said pan-shaped back, and a wall hanger for securement on a wall, said wall hanger extending horizontally a greater extent than said sign;

said hanger means on said pan-shaped back being hooked upon said wall hanger, whereby additional signs like said sign may be supported from said wall hanger beside said sign, yet have the illuminated sidewall means of each remain largely visible over the full depth thereof from directly in front thereof.

* * * * *